US010526115B1

(12) United States Patent
Hawry

(10) Patent No.: US 10,526,115 B1
(45) Date of Patent: Jan. 7, 2020

(54) CONTAINER ASSEMBLY WITH CHILD RESISTANT CLOSURE

(71) Applicant: Berlin Packaging, LLC, Chicago, IL (US)

(72) Inventor: Liam Hawry, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 16/145,495

(22) Filed: Sep. 28, 2018

(51) Int. Cl.
*B65D 50/04* (2006.01)
*B65D 1/16* (2006.01)

(52) U.S. Cl.
CPC ..... *B65D 50/043* (2013.01); *B65D 1/165* (2013.01); *B65D 2215/02* (2013.01)

(58) Field of Classification Search
CPC ..... B65D 50/00–043; B65D 1/00–165; B65D 2215/00–02
See application file for complete search history.

(56) References Cited

U.S. PATENT DOCUMENTS 3,669,294 A * 6/1972 Petronelli ..... B65D 50/041 215/220
3,857,505 A * 12/1974 Mumford ..... B65D 50/041 215/220
3,994,709 A * 11/1976 Venti ..... B65D 1/0246 65/46
4,002,258 A * 1/1977 Curry ..... B65D 50/041 215/206
4,039,097 A * 8/1977 Venti ..... B65D 1/0246 215/12.2
4,165,813 A * 8/1979 Babiol ..... B65D 50/041 215/220
4,347,943 A * 9/1982 Hackwell ..... B65D 43/0212 215/320
2005/0039416 A1* 2/2005 Hidding ..... B65D 1/023 53/397
2018/0312312 A1* 11/2018 Acevedo ..... B65D 55/026

* cited by examiner

*Primary Examiner* — Kareen K Thomas
(74) *Attorney, Agent, or Firm* — Adam K. Sacharoff; Much Shelist, P.C.

(57) ABSTRACT

In one embodiment there is provided a container assembly configured to hold a substance and including a container and closure configured to thread together. The container having a single continuous channel around an exterior region of its sidewall. The assembly further having a sleeve positioned around the secured closure and container and having a sleeve wall extending from an opened bottom end to an opened top end. The sleeve further further having at least one flange extending internally and fitting into the channel on the container, such that the sleeve freely rotates around the closure. The sleeve is thus configured to freely rotate to prevent a user from removing the closure from the container until pressure is applied downwardly on the top of the closure and applied upwardly on the bottom of the container while twisting in opposite directions.

7 Claims, 10 Drawing Sheets

CONTAINER ASSEMBLY WITH CHILD RESISTANT CLOSURE

FIELD OF THE INVENTION

The present invention relates generally to container assemblies and more specifically to a container having a removable closure.

BACKGROUND OF THE INVENTION

Container assemblies typically include a closure for containing a pharmaceutical or nutritional product within a bottle or other container. The cap may be "child-resistant," such that the cap is difficult for children. However, oftentimes seniors also have difficulty in removing the cap from the container. Child resistant closures for screw type container finishes are often referred to as "push and turn" and "squeeze and turn." The former type requires the user to push down on the closure in order to remove the closure from the container. The latter requires sides of the closure to be squeezed in order to remove the closure from the container.

Push and turn closures may include an outer cap and an inner cap. The inner cap is typically free to rotate and move vertically within the outer cap. Push and turn closures are known to cause problems in filling lines due to overall height variations of the closure. The two pieces generally engage with one another creating a single acting closure to open. Generally, the engagement between the two pieces is by gear or ratchet mechanism. Two piece enclosures are expensive to manufacture and can be difficult to open. Squeeze and turn closures can be difficult for adults having limited dexterity and strength from arthritis and similar joint diseases to grip and open.

It would be desirable to construct and implement an extremely simple push and turn child resistant closure which is easy for adults to open while maintaining child resistance, because persons whom operate the caps frequently have impaired hand strength and dexterity that may render opening caps difficult.

SUMMARY OF THE INVENTION

In one embodiment of the present invention there is provided a container assembly configured to hold a substance. The assembly defined by a container, closure, and sleeve.

The container has a bottom terminating into a sidewall that extends upwardly to surround an internal cavity. The container further has a neck with threads about an upper end of the sidewall and further has a single continuous channel around an exterior region of the sidewall. The closure has a top terminating to a downwardly extending skirt and has threads extending internally on the skirt and corresponding to the threads on the neck of the container such that the closure rotates about the neck to close and open the container. When the closure is secured onto the container, the secured closure and container together define a full length measured from the bottom of the container to the top of the closure.

The sleeve is positioned around the secured closure and container and has a sleeve wall extending from an opened bottom end to an opened top end. The sleeve further has a length substantially equal to the full length the secured closure and container together. The sleeve further has at least one flange extending internally and fitting into the channel on the container, such that the sleeve is configured to freely rotate around the closure when the at least one flange is fit into the channel.

Therefore, the sleeve is configured to freely rotate to prevent a user from removing the closure from the container until pressure is applied downwardly on the top of the closure and applied upwardly on the bottom of the container while twisting in opposite directions.

In other embodiments of the container assembly the channel is positioned about a mid-section of the sidewall between the bottom and the neck. Additionally, the at least one flange may be a single continuous flange extending around an entire internal region of the sleeve wall. The thickness and size of the at least one flange may also be configured to prevent the sleeve from being removed from the container.

In yet other embodiments of the container assembly the sleeve may be configured with an internal diameter that has a minimum clearance of space between the internal diameter of the sleeve and an external diameter of the container to permit the free rotation of the sleeve about the container and prevent a grasping of an edge of the closure. In this embodiment, the percent difference between the internal diameter of the sleeve and the external diameter of the container may be less than 1%, or in other embodiments less than 0.5%.

Numerous other advantages and features of the invention will become readily apparent from the following detailed description of the invention and the embodiments thereof, from the claims, and from the accompanying drawings.

BRIEF DESCRIPTION OF THE. DRAWINGS

A fuller understanding of the foregoing may be had by reference to the accompanying drawings, wherein.

DETAILED DESCRIPTION OF THE DRAWINGS

Figure 1:
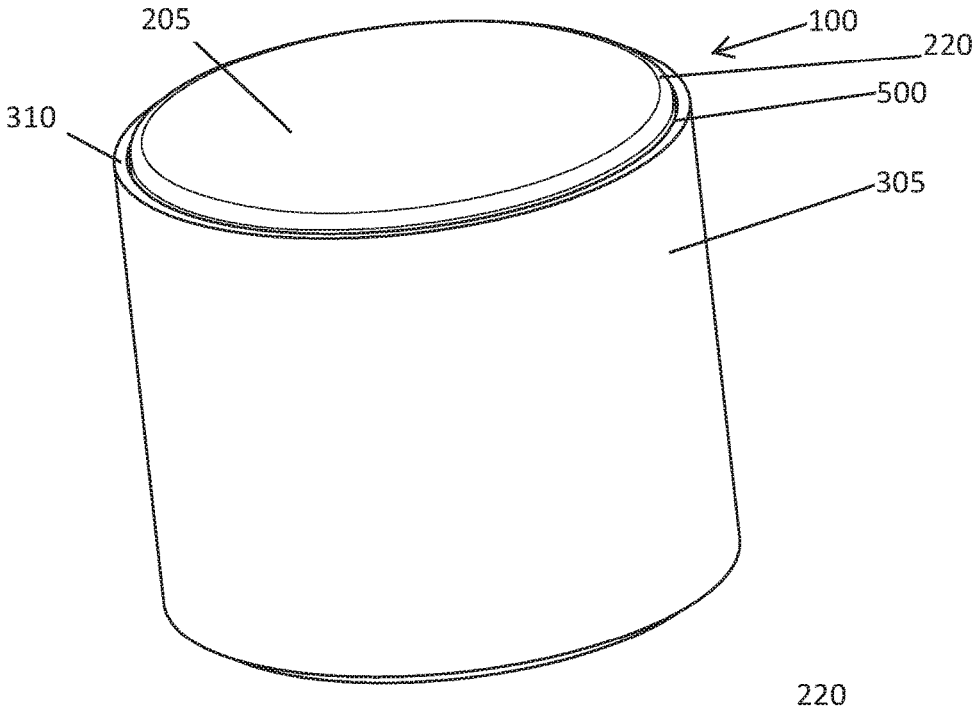
FIG. 1 is a perspective view of a container assembly with child resistant closure in accordance with an embodiment of the invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
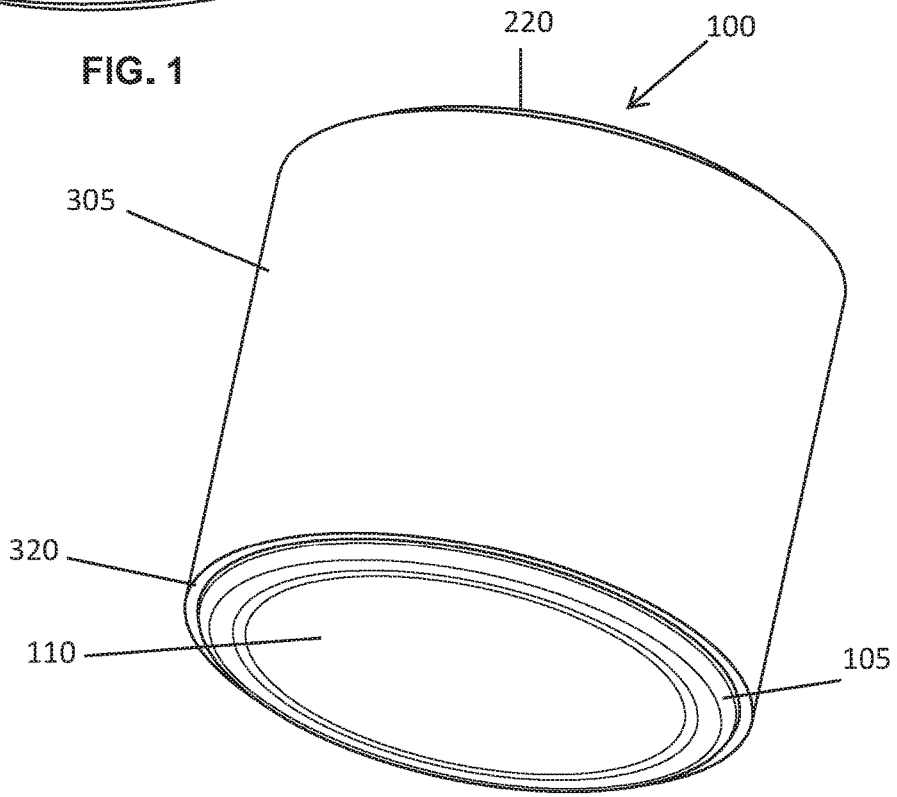
FIG. 2 is another perspective view of the container assembly with child resistant closure from FIG. 1.
Figure 3:
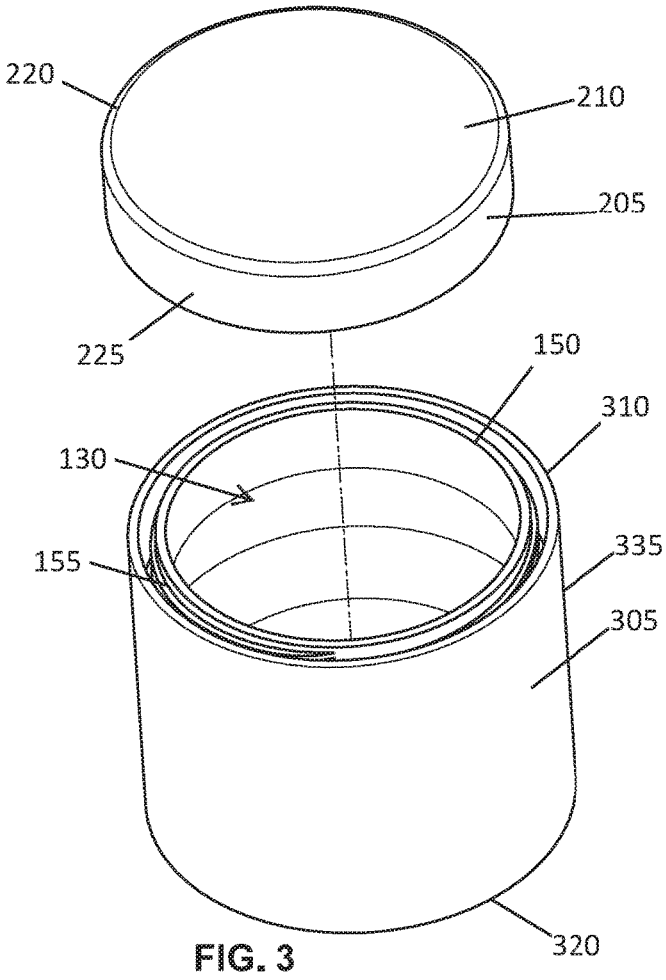
FIG. 3 is a perspective view of the container assembly with the closure removed from the container.
Figure 4:
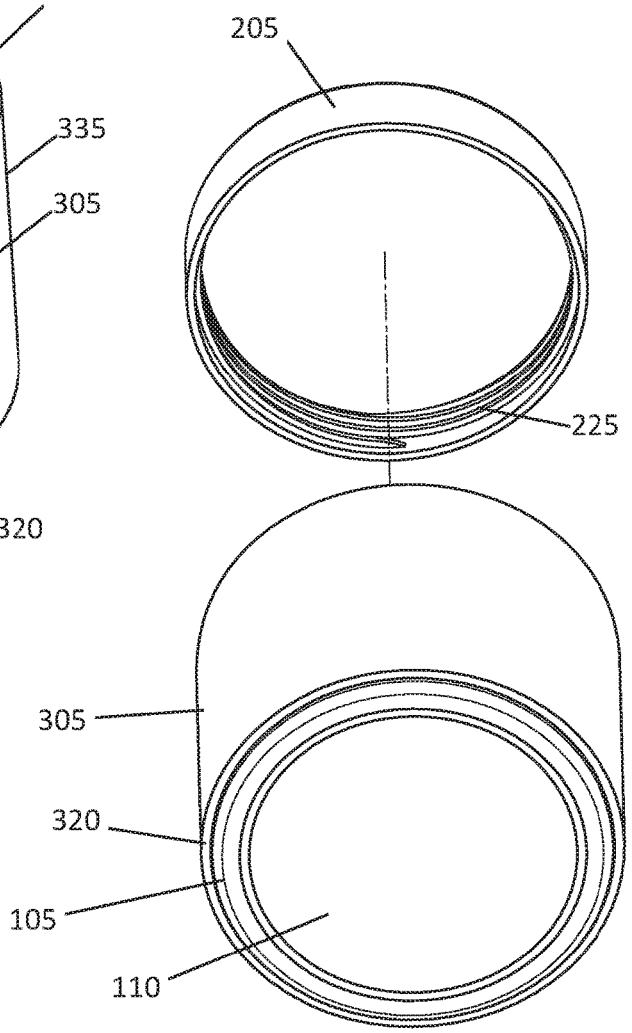
FIG. 4 is another perspective view of the container assembly illustrated in FIG. 3.
Figure 5:
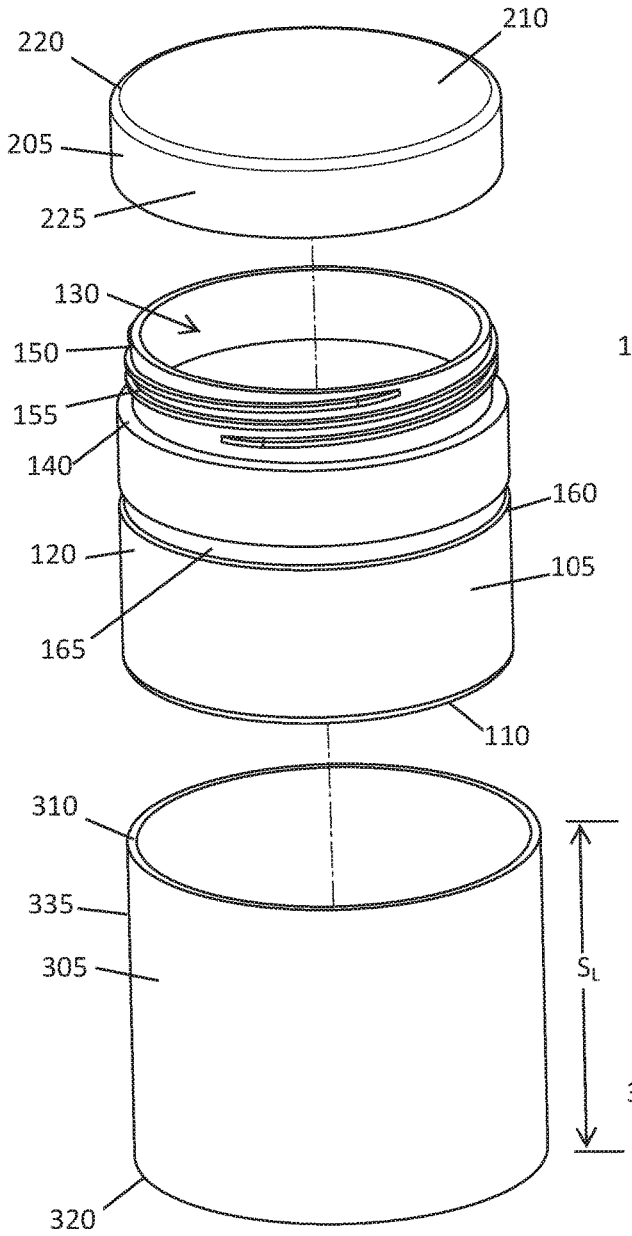
FIG. 5 is an exploded view of the container assembly in accordance with another embodiment of the invention.
Figure 6:
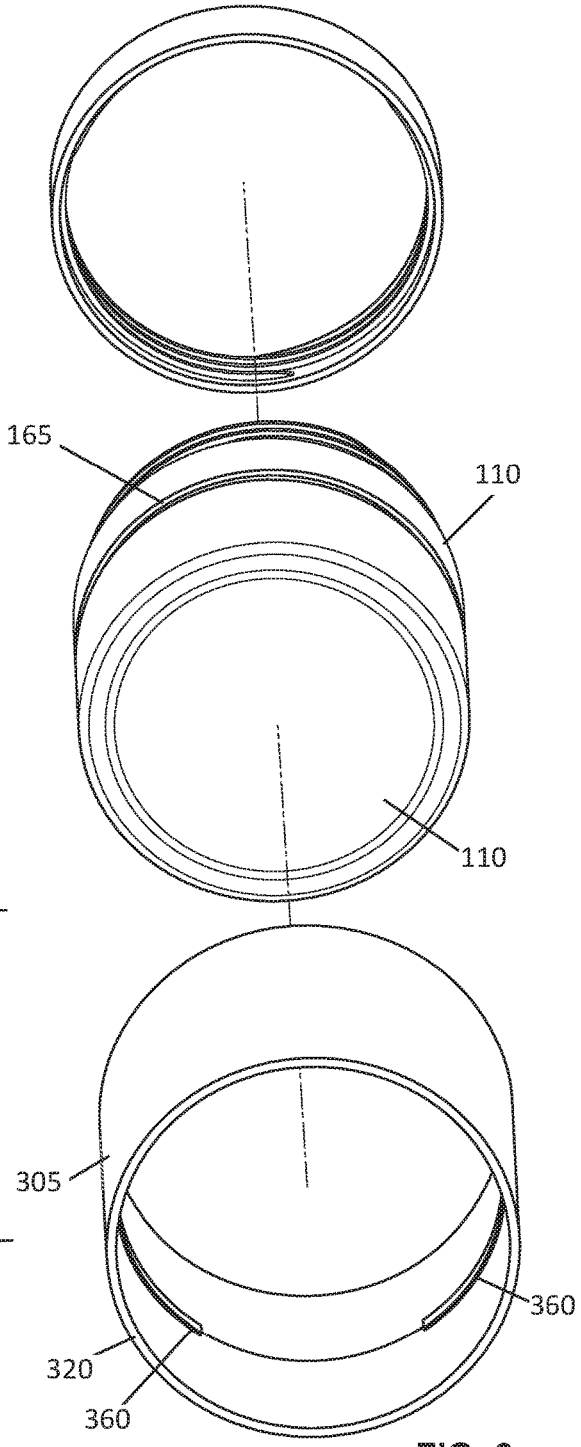
FIG. 6 is another exploded view of FIG. 5.
Figure 7:
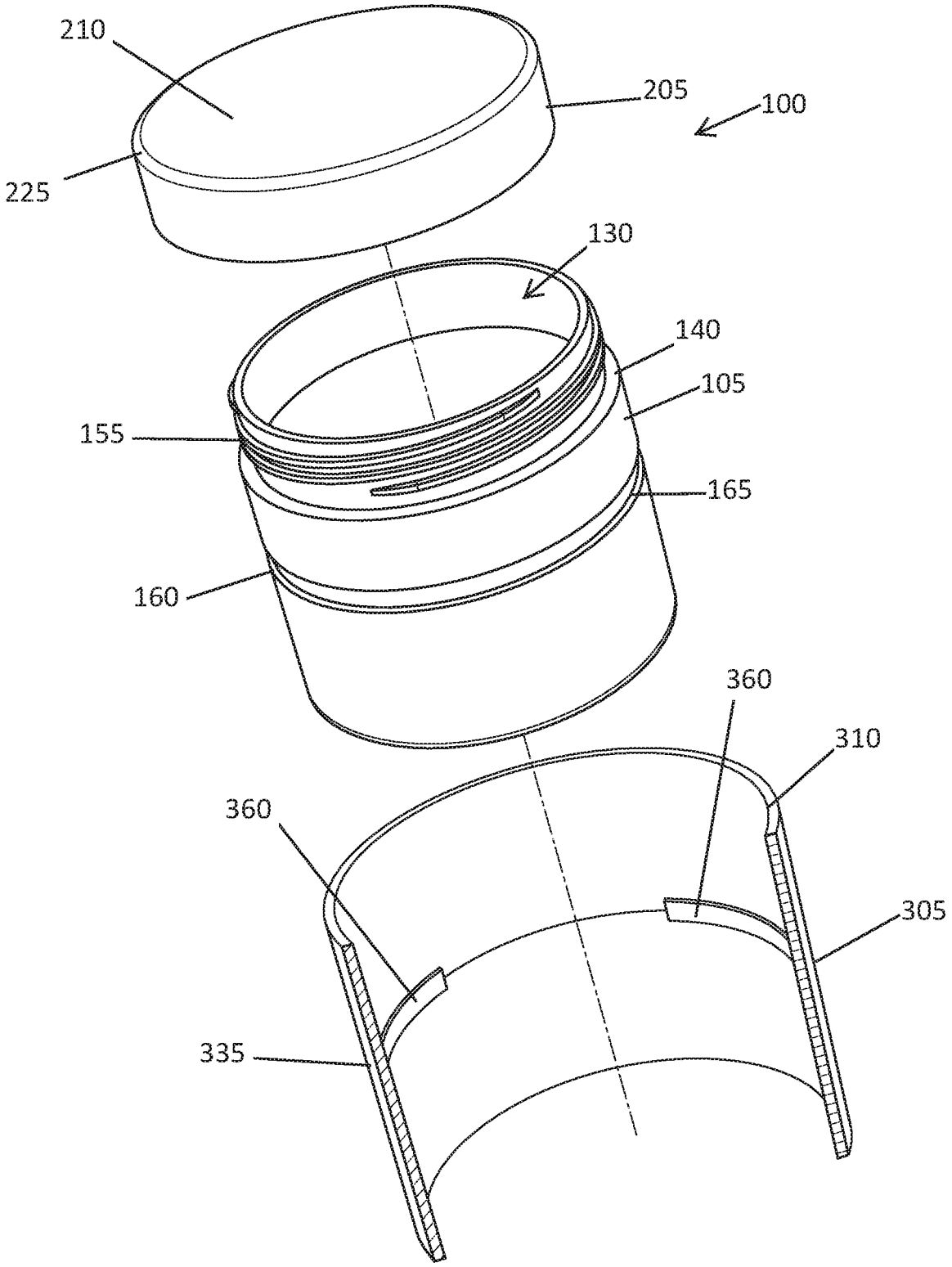
FIG. 7 is an exploded view of the container assembly illustrating the sleeve in a sectional view.
Figure 8:
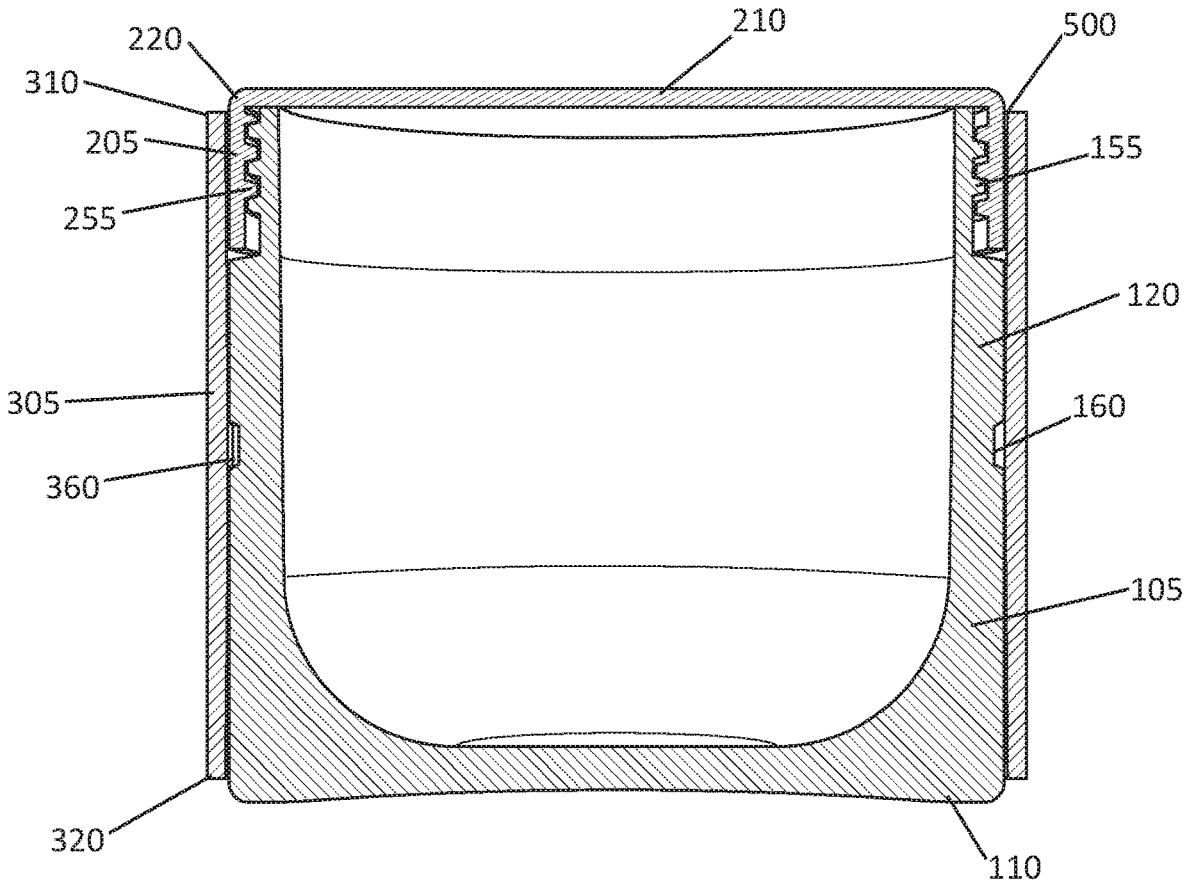
FIG. 8 is a cross section view of the container assembly in accordance with another embodiment of the invention.
Figure 9:
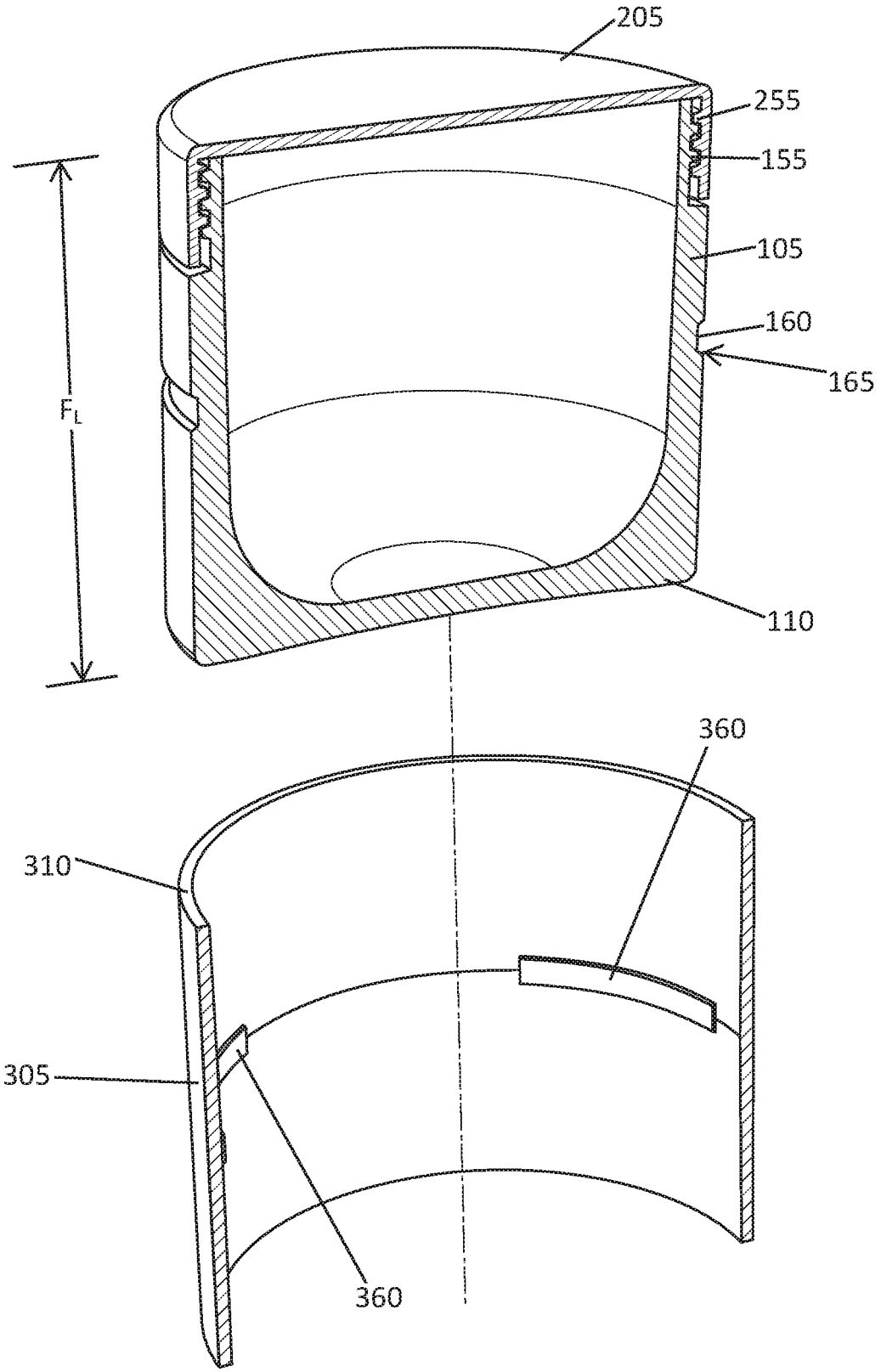
FIG. 9 is a sectional view of the container assembly with the sleeve removed from the container and closure.
Figure 10:
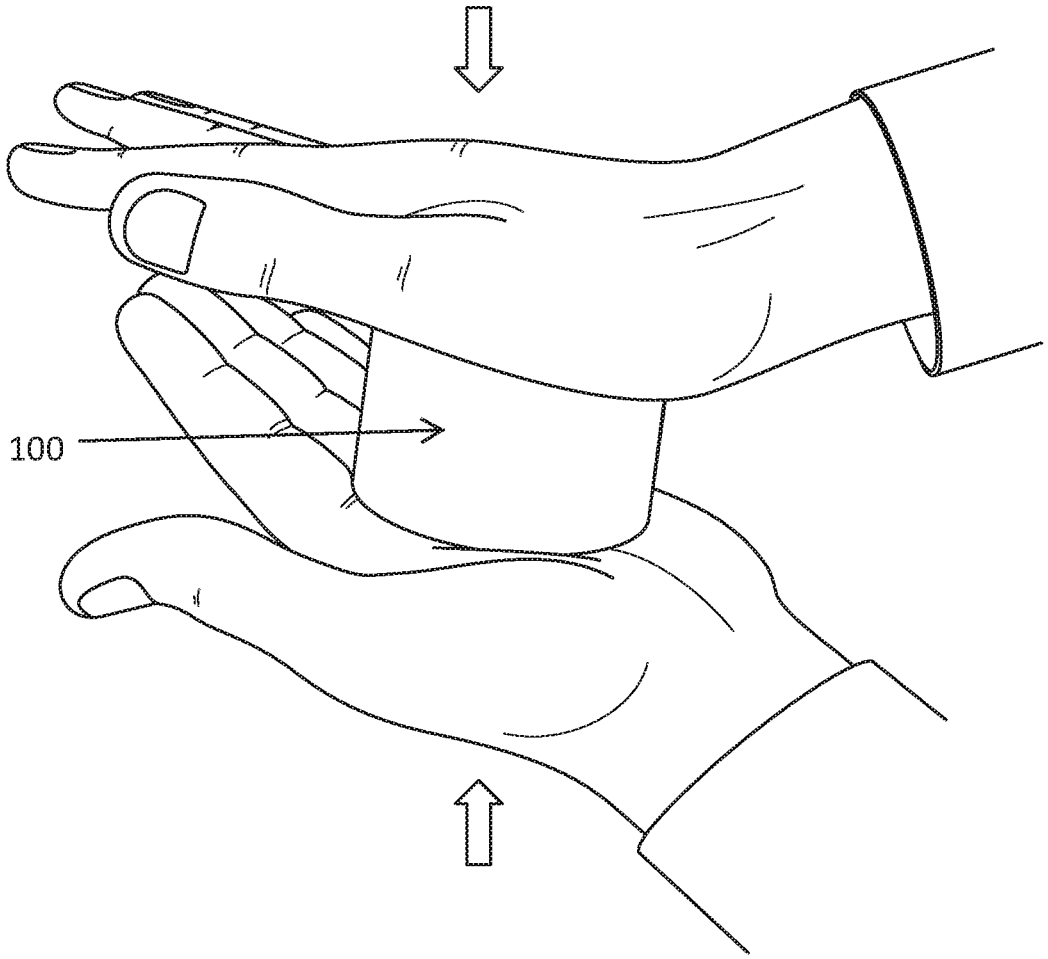
FIGS. 10 through 13 illustrate the steps required for opening the container assembly with child resistant closure of the container.
Figure 11:
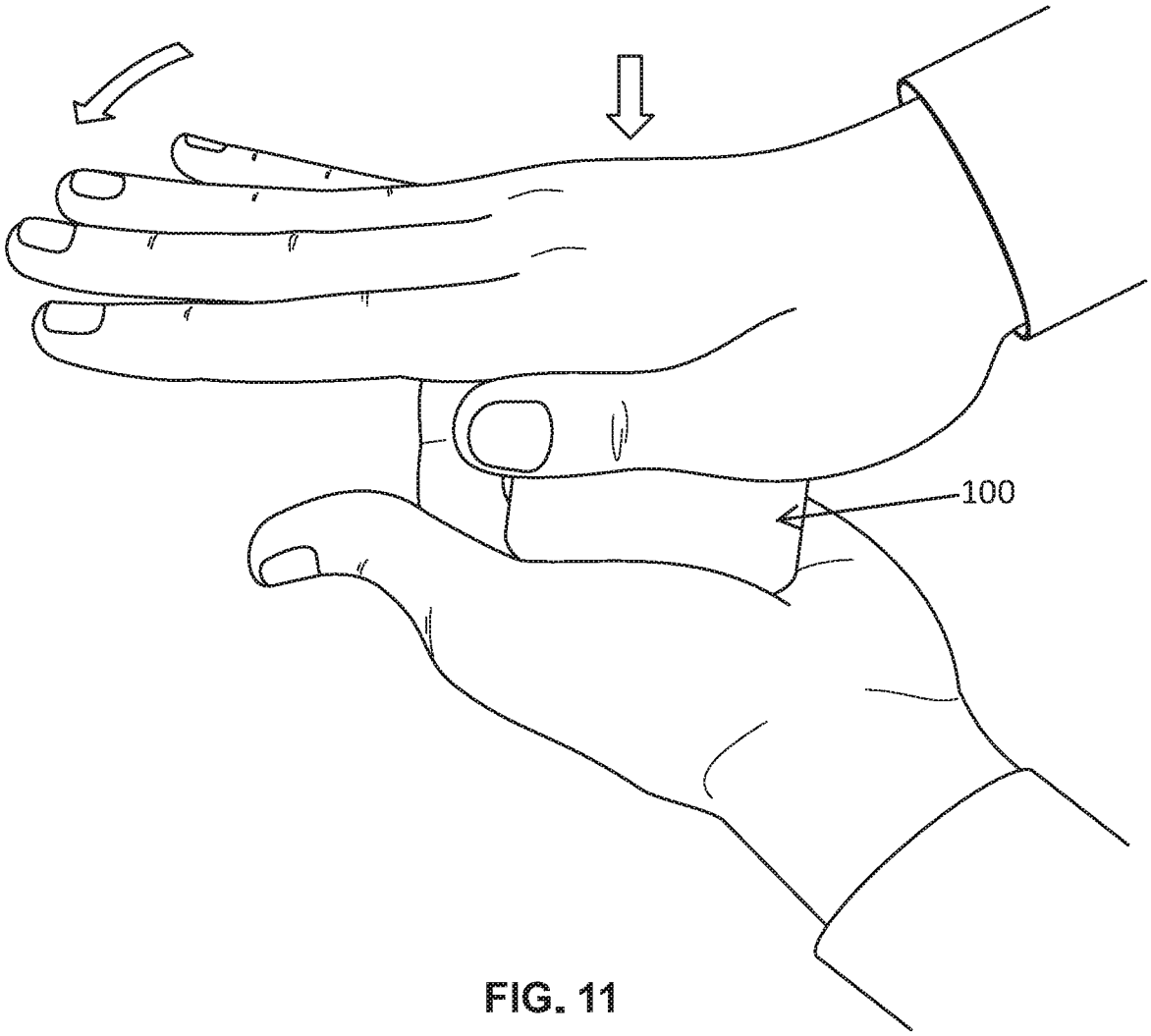
Figure 12:
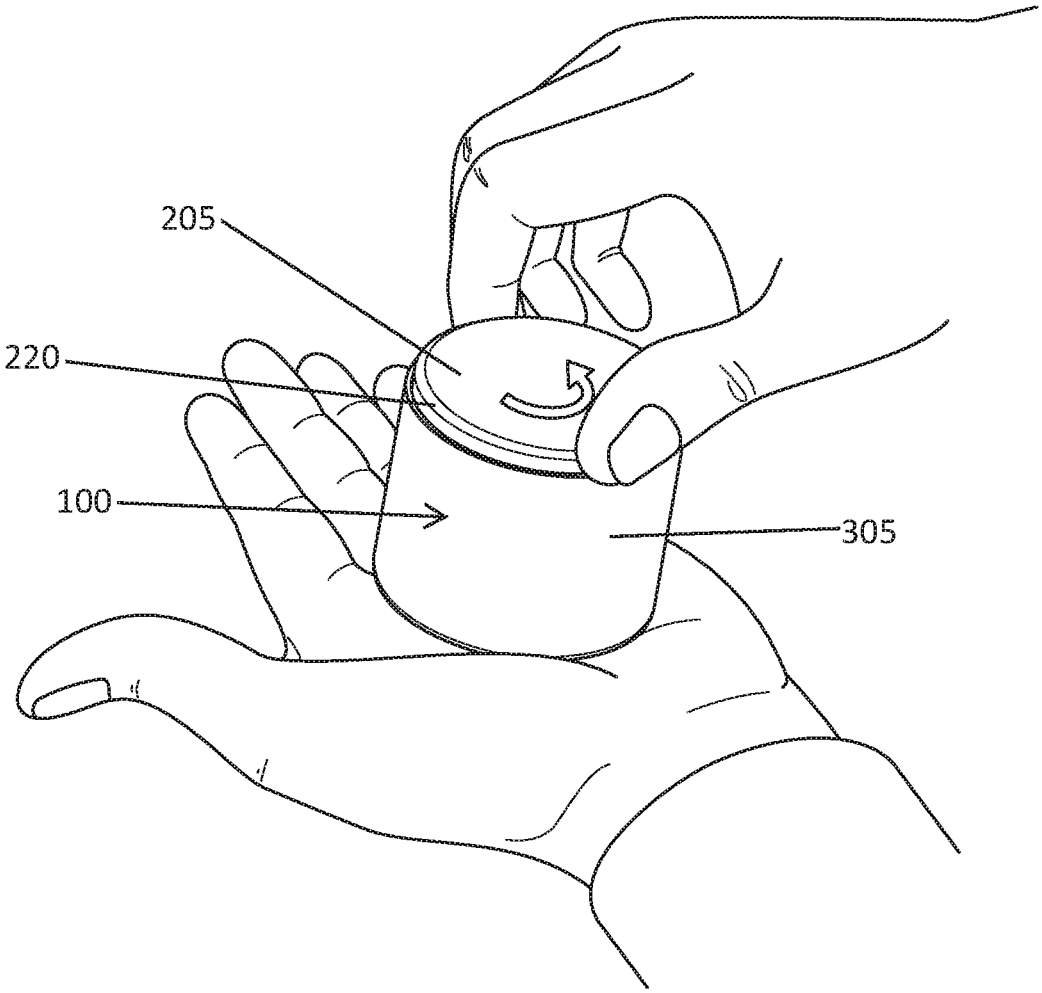
Figure 13:
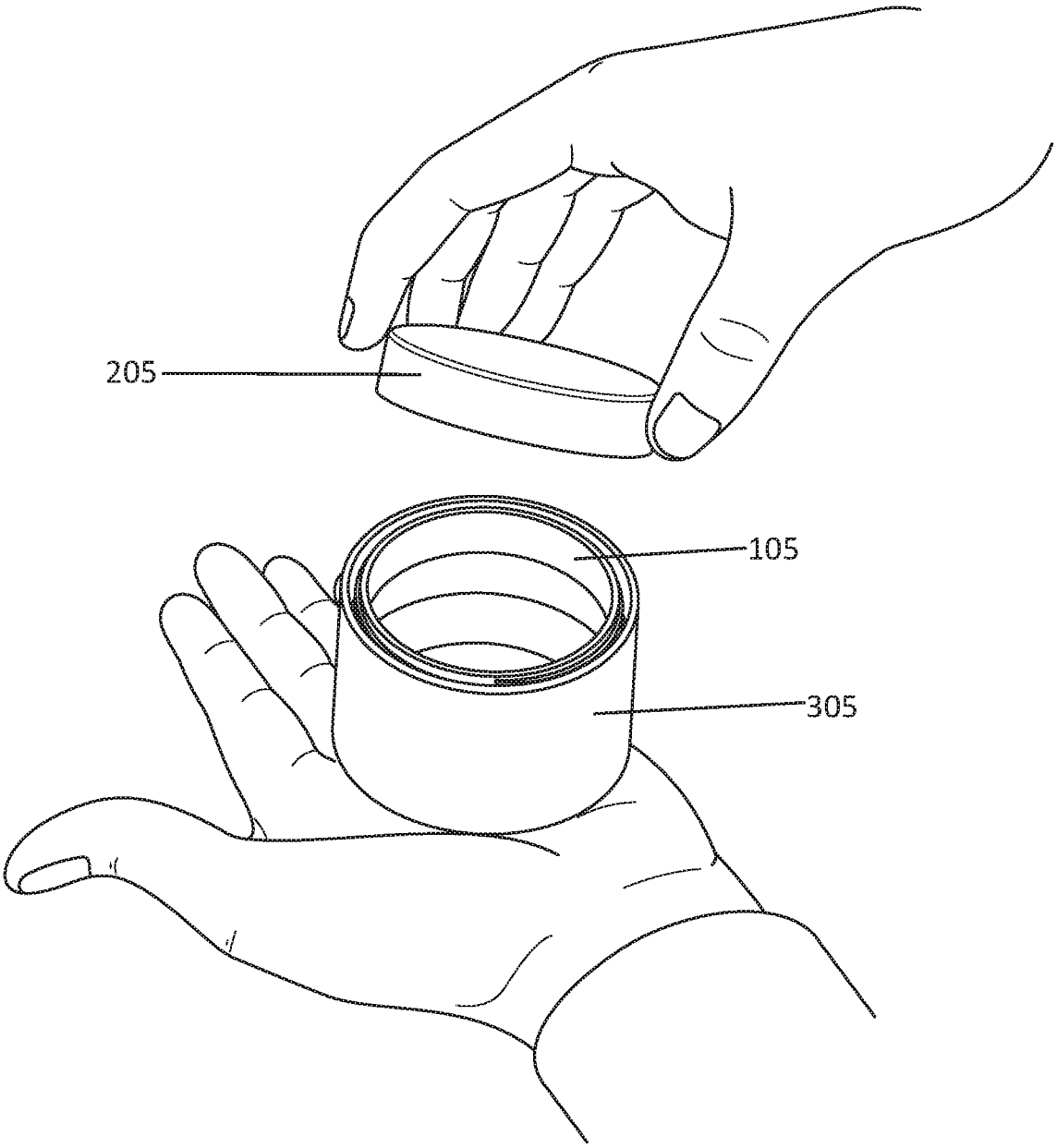

Referring now to the figures, namely FIGS. 1 through 13, there is shown a container assembly 100. The container assembly 100 may be used for storing and/or dispensing pharmaceutical or nutritional products, such as tablets, caplets, powders, or other forms of medication. The container assembly 100 is preferably a child-resistant container assembly 100. The container assembly 100 may be used for storing various types of material other than medication, such as a powder for drug reconstitution or nearly any other item that has a size and shape that is able to fit into the container assembly. The container assembly 100 preferably includes a container 105, a closure 205, and a sleeve 305.

As used herein, the term "container" refers to any type of storage receptacle for holding solid, liquid or gaseous material, including but not limited to bottles, vials, tubes, vessels, or other receptacles, having at least one opening for depositing or dispensing contents. The term "cap" refers to any type of closure for closing the opening of a container, including but not limited to lids, covers and seals.

The container 105 includes a bottom 110 terminating to a sidewall 120 that extends upwardly and surrounds an internal cavity or containment area 130 therein. The upper end 140 of the sidewall 120 terminates to a neck 150, which includes threads 155. Positioned around the entire sidewall 120 of the container 105 is a channel 160. Preferably the channel 160 is about a mid-section 165 of the sidewall 120 between the bottom 110 and the neck 150.

The closure 205 includes a top 210 terminating to a shoulder 220 that extends downwardly into a skirt 225. The closure 205 internally has threads 255 corresponding to the threads 155 on the neck of the container. The closure 205 simply closes over the cavity of the container 105 in a typical fashion.

The present invention further includes a sleeve 305 that has a length $S_L$ that extends and matches the full length $F_L$ of the container 205 and closure 305 when assembled. The sleeve 305 is opened at both a top end 310 and bottom end 320 and simply includes a sleeve wall 335 that extends and surrounds the two ends 310 and 320. The sleeve wall 335 includes one or more flanges 360 extending inwardly around an interior region 350 of the sleeve wall 335. The one or more flanges 360 can be a single flanges or multiple flanges. For example, a single flange can extend around the entire interior region 350 of the sleeve wall 335 or may extend only partially around. In addition, multiple flanges can be used and in the instance case the figures illustrate the use of three equally spaced flanges. The flange(s) 360 are also sized and positioned to be received within the channel 160. The thickness and size of the flanges are also specifically configured to provide little clearance between the two such that when the sleeve 305 is positioned over the container and cap it freely rotates or spins about the channel providing little to no friction to the overall assembly; as well as preventing the removal of the sleeve from the assembly.

In operation and in further reference to FIGS. 10-13, a user when holding the sleeve 305 has little to no clearance to insert or use their fingers to twist open the closure 205 and thus cannot remove the closure 205 from the container 105. In addition, the sleeve 305 freely rotates providing no resistance to the container 105. As such, if the user is holding the sleeve and pressing down on the closure 205 or pressing up on the container 105 the sleeve simply spins preventing the opening of the container. In addition, the sleeve may be made from a material that is resistant to squeezing thereby preventing opening by squeezing the sleeve while pressing down on the closure 205 or pressing up on the container 105. The current configuration therefore only allows opening of the container by pressing down on the closure while pressing up on the container and twisting the two in an opposite direction. Once opened enough, the user can then grip the closure with their figures and remove the closure.

The sleeve is further configured with an internal diameter that has a minimum clearance of space 500 between the internal diameter of the sleeve and an external diameter of the container to permit the free rotation of the sleeve about the container and prevent a grasping of an edge of the closure. The minimum clearance of space can be defined as a percent difference between the internal diameter of the sleeve and the external diameter of the container and defined to be less than 1%, or in more preferred embodiments less than 0.5%.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

I claim:

1. A container assembly configured to hold a substance comprising:

a container having a bottom, terminating into a sidewall, that extends upwardly to surround an internal cavity, the container further having a neck with threads about an upper end of the sidewall, the container further having a single continuous channel around an exterior region of the sidewall;

a closure having a top terminating to a downwardly extending skirt, the closure further having threads extending internally on the skirt and corresponding to the threads on the neck of the container such that the closure rotates about the neck to close and open the container, and wherein when the closure is secured onto the container, the secured closure and container together define a full length measured from the bottom of the container to the top of the closure; and a sleeve positioned around the secured closure and container and having a sleeve wall extending from an opened bottom end to an opened top end, the sleeve further having a length substantially equal to the full length the secured closure and container together, and the sleeve further having at least one flange extending internally and fitting into the channel on the container, the sleeve is configured to freely rotate around the closure when the at least one flange is fit into the channel, whereby the sleeve is configured to freely rotate to prevent a user from removing the closure from the container until pressure is applied downwardly on the top of the closure and applied upwardly on the bottom of the container while twisting in opposite directions.

2. The container assembly of claim 1, wherein the channel is positioned about a mid-section of the sidewall between the bottom and the neck.

3. The container assembly of claim 1, wherein the at least one flange is a single continuous flange extending around an entire internal region of the sleeve wall.

4. The container assembly of claim 1, wherein a thickness and size of the at least one flange is configured to prevent the sleeve from being removed from the container.

5. The container assembly of claim 1, wherein the sleeve is further configured with an internal diameter that has a minimum clearance of space between the internal diameter of the sleeve and an external diameter of the container to permit the free rotation of the sleeve about the container and prevent a grasping of an edge of the closure.

6. The container assembly of claim 5, wherein a percent difference between the internal diameter of the sleeve and the external diameter of the container is less than 1%.

7. The container assembly of claim 5, wherein a percent difference between the internal diameter of the sleeve and the external diameter of the container is less than 0.5%.

* * * * *